US008028493B2

(12) United States Patent
Holmes et al.

(10) Patent No.: US 8,028,493 B2
(45) Date of Patent: Oct. 4, 2011

(54) FLOOR CONSTRUCTION METHOD AND SYSTEM

(75) Inventors: Andrew Holmes, Holmfirth (GB); Michael Hawes, Petit Wood (GB)

(73) Assignee: ASD Westok Limited, Wakefield (GB)

( * ) Notice: Subject to any disclaimer, the term of this patent is extended or adjusted under 35 U.S.C. 154(b) by 212 days.

(21) Appl. No.: 11/916,064

(22) PCT Filed: May 19, 2006

(86) PCT No.: PCT/GB2006/001845

§ 371 (c)(1),
(2), (4) Date: Dec. 3, 2008

(87) PCT Pub. No.: WO2006/129057

PCT Pub. Date: Dec. 7, 2006

(65) Prior Publication Data

US 2009/0100794 A1 Apr. 23, 2009

(30) Foreign Application Priority Data

May 31, 2005 (GB) ..... 0510975.6

(51) Int. Cl.
*E04B 1/20* (2006.01)

(52) U.S. Cl. ..... 52/837; 52/745.05

(58) Field of Classification Search ..... 52/332, 52/333, 334, 320, 321, 322, 323, 336, 338, 52/340, 837, 836, 745.05; 29/897, 897.3, 29/897.31, 897.312, 897.32, 897.34, 525.01, 29/525.11, 525.14

See application file for complete search history.

(56) References Cited

U.S. PATENT DOCUMENTS

| | | | | | |
|---|---|---|---|---|---|
| 1,033,106 | A | * | 7/1912 | Kahn | 52/88 |
| 1,577,394 | A | * | 3/1926 | Wehr | 104/109 |
| 1,594,658 | A | * | 8/1926 | Bushong | 52/838 |
| 1,644,940 | A | * | 10/1927 | Moyer | 29/897.31 |
| 1,676,258 | A | * | 7/1928 | Fork | 29/897.31 |
| 1,741,423 | A | * | 12/1929 | Lachman | 52/636 |
| 1,843,318 | A | * | 2/1932 | Frease | 52/690 |
| 2,002,044 | A | * | 5/1935 | Rothenstein | 52/636 |
| 3,050,831 | A | * | 8/1962 | Diamond | 29/897.31 |
| 3,066,394 | A | | 12/1962 | Litzka | |
| 3,197,610 | A | | 7/1965 | Litzka | |
| 3,203,146 | A | * | 8/1965 | Carter | 52/328 |
| 3,217,659 | A | * | 11/1965 | Ford, Jr. | 104/109 |
| 3,263,387 | A | * | 8/1966 | Simpson | 52/634 |
| 3,283,464 | A | * | 11/1966 | Litzka | 52/636 |
| 3,397,858 | A | | 8/1968 | Williams | |
| 3,736,716 | A | * | 6/1973 | Nishimura | 52/334 |
| 3,874,051 | A | * | 4/1975 | Malik | 29/897.31 |
| 4,115,971 | A | * | 9/1978 | Varga | 52/334 |
| 4,151,694 | A | * | 5/1979 | Sriberg et al. | 52/665 |
| 4,653,237 | A | * | 3/1987 | Taft | 52/335 |
| 4,785,600 | A | * | 11/1988 | Ting | 52/334 |

(Continued)

FOREIGN PATENT DOCUMENTS

EP 0324206 7/1989

*Primary Examiner* — Basil Katcheves
*Assistant Examiner* — Beth Stephan
(74) *Attorney, Agent, or Firm* — Kirton & McConkie; Evan R. Witt

(57) ABSTRACT

This invention relates to a floor construction method and system, and more particularly to a method for producing shallow and ultra shallow steel floor systems.

15 Claims, 12 Drawing Sheets

U.S. PATENT DOCUMENTS

| | | | | | |
|---|---|---|---|---|---|
| 4,894,898 | A * | 1/1990 | Walker | 29/897.35 |
| 5,524,410 | A * | 6/1996 | Menchetti | 52/838 |
| 5,561,957 | A * | 10/1996 | Gauthier | 52/334 |
| 5,588,273 | A * | 12/1996 | Csagoly | 52/634 |
| 5,595,034 | A * | 1/1997 | Krysalka et al. | 52/318 |
| 5,704,181 | A * | 1/1998 | Fisher et al. | 52/438 |
| 6,012,256 | A * | 1/2000 | Aschheim | 52/167.1 |
| 6,332,301 | B1 * | 12/2001 | Goldzak | 52/838 |
| 6,442,908 | B1 | 9/2002 | Naccarato et al. | |
| 6,807,789 | B1 | 10/2004 | Kim et al. | |
| 6,845,591 | B1 * | 1/2005 | van Paassen et al. | 52/220.1 |
| 7,197,854 | B2 * | 4/2007 | Bettigole et al. | 52/414 |
| 2005/0034418 | A1 | 2/2005 | Bravinski | |
| 2007/0272342 | A1 * | 11/2007 | Holmes | 156/73.5 |
| 2009/0229219 | A1 * | 9/2009 | Rutman et al. | 52/836 |

* cited by examiner

FLOOR CONSTRUCTION METHOD AND SYSTEM

BACKGROUND OF THE INVENTION

This invention relates to a floor construction method and system, and more particularly to a method for producing shallow and ultra shallow steel floor systems. Ultra-shallow steel floor systems may be defined as those having depths in the range 100 mm to 350 mm.

In multi-storey buildings it has become increasingly important to minimise the overall floor-to-floor height, and consequently the depth taken up by any floor structure needs to be minimised. This need is driven by increased levels of servicing accommodated within modern ceiling and floor zones, and the desire to accommodate as many floors as possible, without contravening planning restrictions on the allowable overall building height. Historically, very compact construction was achieved by using thin structural concrete slab with closely spaced columns.

In recent years engineers have sought methods to construct equally compact floors in steel rather than concrete. This invention is such a form of construction, being shallower, more practical, more economical and more flexible than existing technology, with the added benefit of achieving larger spans.

In traditional, non-shallow, multi-storey steel construction, a steel I or H-beam spans horizontally between supports, with concrete flooring placed on top of the steel beam spanning between adjacent beams. Thus the steel forms the building skeleton and the horizontal concrete forms the floor. In shallow construction instead of the concrete sitting on top of the steel I or H-beam, it is accommodated within the depth of the beam itself, thus significantly reducing the thickness of the overall floor.

For shallow floor construction it is very difficult to use standard H-section because the concrete flooring unit cannot be safely lowered into place without fouling the projection of the top flange of the H-section.

It is therefore preferable to use an asymmetric steel beam, where the top flange is substantially narrower than the bottom flange. The difference between the two flange widths has to be sufficient to allow the concrete unit to be easily and safely lowered onto the wider bottom flange. Several forms of asymmetric shallow steel beams are known, but each has significant drawbacks.

SLIMDEK ASB® beams are asymmetric steel beams, rolled by Corus. The top flange is 110 mm narrower than the bottom flange. However, these beams have several drawbacks:

a) There is a very limited range of section sizes, consisting of 10 depths in increments between 272 mm to 342 mm;
b) The shallowest, 272 mm deep, is too deep for many ultra-shallow floors;
c) In order to achieve composite action sufficient cover of concrete and reinforcement must be placed over the Slimdek top flange, further increasing depth;
d) Due to the small number of beams in the range, the weight increase from one to the next strongest is very substantial, making for unnecessarily heavy construction.

SLIMFLOR® Beams are standard rolled H-beams with a wide plate welded to the underside of the bottom flange to produce an asymmetric profile. This has the benefit of providing a greater range of beam depths, but is still restricted by the limited range of H-beams available in any market.

Welded Plate Beams can be produced by welding together two horizontal plates separated by a vertical plate to form an I or H-beam. An asymmetric profile is achieved by using horizontal plates of differing widths. The benefit of this is that the depth of the H-beam is totally flexible, as the vertical web-plate can be made to any required depth. However, most commercially available automated welding systems cannot gain access to weld a beam less than 300 mm in depth. Moreover, unless the welds that join the vertical and horizontal plates are full strength butt welds, which are prohibitively expensive, a plate H-beam is significantly inferior to rolled section in its load carrying capacity.

Each of the above types of steel beam have another important practical drawback. In modern buildings, numerous services (such as power cables, communication lines, water pipes, air ducts) are required for each floor of the building. It is advantageous to locate such service structures within the floor construction itself.

SUMMARY OF THE INVENTION

The present invention provides a floor construction method and system that enables the construction of robust flooring and which enables various service structures to be located within the floor structure. The present invention also provides a structural beam with openings in the web and a method of producing such a structural beam, the structural beam being suitable for use in the floor construction method and system of the present invention.

According to an aspect of the present invention, there is provided a method of constructing a floor, comprising the steps of:

(a) arranging a plurality of I- or H-shaped beams comprising at least one pre-formed beam with openings located in the web so as to form a support structure for floor units; and
(b) disposing floor units between the beams, the floor units being accommodated between the horizontal flanges of the beams.

According to another aspect of the present invention, there is provided a floor system, comprising:

a plurality of I- or H-shaped beams comprising at least one pre-formed beam with openings located in the web arranged so as to form a support structure for floor units; and floor units disposed between the beams, the floor units being accommodated between the horizontal flanges of the beams.

Preferably, the beams are asymmetric, most preferably with the top flange being narrower than the bottom flange.

Decking may be disposed between the bottom flanges of the beams, the floor units being disposed on top of the decking. The decking may be flat sheets, for example metal sheets. The decking may have undulations, for example troughs. The decking may be fixed to the beam.

The floor units may be pre-formed concrete slabs, for example pre-cast. Alternatively, concrete floor units may be formed in-situ. Alternatively, the floor units may be a combination of pre-formed and in-situ concrete floor units.

Preferably, decking is disposed between the bottom flanges of the beams, and concrete poured onto the decking so as to form concrete floor units.

According to a preferred embodiment of the invention, the method comprises a floor unit disposed between the flanges of the beam with in-situ formed material contacting the floor unit and the beam. Preferably, the in-situ formed material is introduced as a flowable material. Preferably, the in-situ formed material is concrete. Preferably, the in-situ formed material extends through the openings in the web.

According to an embodiment of the invention, the method comprises a surface supported above the floor unit. Preferably, a space is provided between the surface and the floor unit. Preferably, the space connects to one or more of the openings in the web. Service structures may be located in the space.

The floor units may be timber joists. The floor units may be made of plastic. The floor units may be hybrid flooring units.

The floor units may be hollow pot floor units. The floor units may be block and beam type floor units.

Adjacent floor units may be attached to each other. Preferably, adjacent concrete slabs are attached to each other ideally by reinforcing means, such as steel rods. In the case of preformed concrete slabs, the reinforcing means may be connected to adjacent concrete slabs. In the case of concrete slabs formed in-situ, the reinforcing means are embedded in the adjacent concrete slabs. Adjacent timber joists may be bolted together, or joined by other mechanical means such as press-gang nail plates, rod and turn buckle, or smaller timber sections which pass through the openings and are affixed either side. The reinforcing means, bolts or other mechanical means may extend between adjacent floor units through the openings located in the web of the beam.

In embodiments of the invention wherein the concrete floor units are formed in-situ, the concrete preferably flows through the openings in the beams so as to form a composite structure.

Service structures, such as power cables, communication lines, water pipes and/or air ducts, may be disposed within the floor. Preferably, the service structures pass through the openings in the or each beam.

The openings located in the web may be pre-formed at the point of generating the structural beams. The openings may be pre-formed prior to positioning the structural beam in the support structure for the floor units.

The openings located in the web of the beam may be pre-formed to have any desired shape. The openings may be pre-formed to have any desired dimensions. The openings may be pre-formed to have any desired positioning with respect to each other. The openings may be specifically preformed so as to be compatible with the mode of attachment of adjacent floor units to one another. The openings may be pre-formed to be compatible with the service structures passing through them. The openings may be pre-formed so as to maximise the flow of concrete through them when forming concrete floor units in-situ.

According to another aspect of the present invention, there is provided a method of producing a structural beam with openings located in the web, comprising the steps of:

(a) taking a first I or H-shaped beam, making a cut generally longitudinally along the web thereof, the cut defining rectilinear sections lying parallel to the longitudinal axis of the beam and at least partly curved sections joining the closest ends of the adjacent rectilinear sections, separating the two parts of the beam;

(b) taking a second I or H-shaped beam, making a cut along the web thereof parallel to the longitudinal axis, separating the two parts of the beam; and (c) welding the rectilinear sections of one part of the first beam to one part of the second beam so as to produce a structural beam with openings.

According to another aspect of the present invention, there is provided a method of producing a structural beam with openings located in the web, comprising the steps of:

(a) taking a first I or H-shaped beam, making a cut generally longitudinally along the web thereof, making a second cut generally longitudinally along the web thereof, the path differing from the first path of the first cut, the two paths being defined rectilinear sections lying on alternative sides of a longitudinal centre line of the web and at least partly curved sections joining the closest ends of the adjacent rectilinear sections, separating the two parts of the beam;

(b) taking a second I or H-shaped beam, making a cut along the web thereof parallel to the longitudinal axis, separating the two parts of the beam; and (c) welding one part of the first beam to one part of the second beam.

The I or H-shaped beam may comprise a web linking two flanges.

Preferably, the first and second beams have different flange widths so that the finished structural beam is asymmetric, with one flange being narrower than the other.

The cut along the web of the first beam can be such that different shaped openings can be obtained. The cut along the web of the first beam can be such that different sized openings can be obtained. The cut along the web of the first beam can be such that any position of openings can be obtained.

According to another aspect of the present invention, there is provided a structural beam when produced by the method of the above aspect of the present invention.

Preferably, the structural beam has an opening in the upper part of the web. Preferably, the curved section of the opening is above the rectilinear section. Preferably the structural beam comprises a web linking two flanges. Preferably, the upper flange is narrower than the lower flange.

BRIEF DESCRIPTION OF THE DRAWINGS

Reference will now be made, by way of example, to the accompanying drawings, in which.

DETAILED DESCRIPTION

Figure 1A:
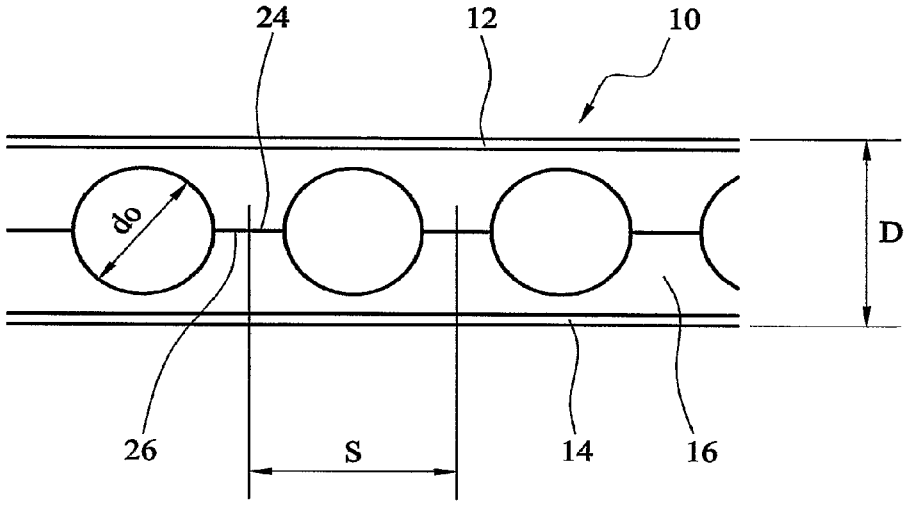
PRIOR ART FIG. 1a
FIGS. 1*a* and 1*b* correspond to FIGS. 1*a* and 1*b* in EP 0324206 and illustrate a finished cellular beam and cut pattern, respectively.
Figure 1B:
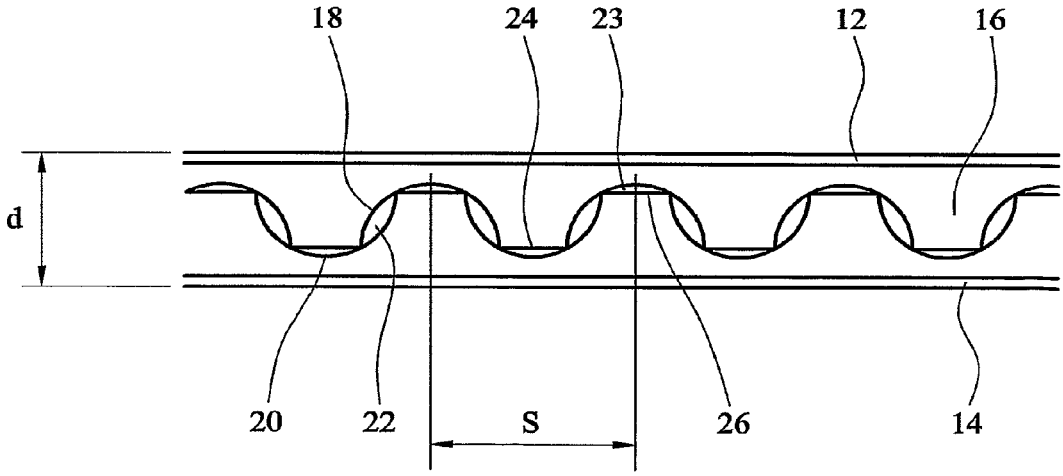
PRIOR ART FIG. 1b

The present invention utilises structural beams with openings in the webs, referred to as "cellular beams". Cellular beams are well known in the art, and those produced according to the method of EP 0324206 are particularly suitable. FIGS. 1*a* and 1*b* correspond to FIGS. 1*a* and 1*b* in EP 0324206 and illustrate a finished cellular beam and cut pattern, respectively.

The method according to EP 0324206 comprises the steps of taking a universal beam, making a cut generally longitudinally along the web thereof, separating the cut halves of the beam, displacing the halves with respect to one another and welding the halves together, characterised in that: a second cut is made along the web, the path differing from the first path of the first cut, the two paths being defined by rectilinear sections lying on alternative sides of a longitudinal centre line of the web and at least partly curvilinear sections joining the closest ends of adjacent rectilinear sections.

As shown in FIGS. 1*a* and 1*b*, a cellular beam (10) has flanges (12,14) between which extends a web (16). The beam (10) is produced from a universal beam (FIG. 1(*b*)), having a depth d which is two-thirds of the depth of the depth D of the finished beam (10) shown in FIG. 1(*a*). The web (16) of the universal beam is cut along two continuous cutting lines (18,20) and the material (22,23) between the lines (18,20) is removed. After the two cuts have been formed, the two halves of the beam are separated and one is moved longitudinally relative to the other in order to juxtapose the rectilinear sections (24,26) which are welded together to produce the finished cellular beam (10) illustrated in FIG. 1(*a*).

Figure 2A:
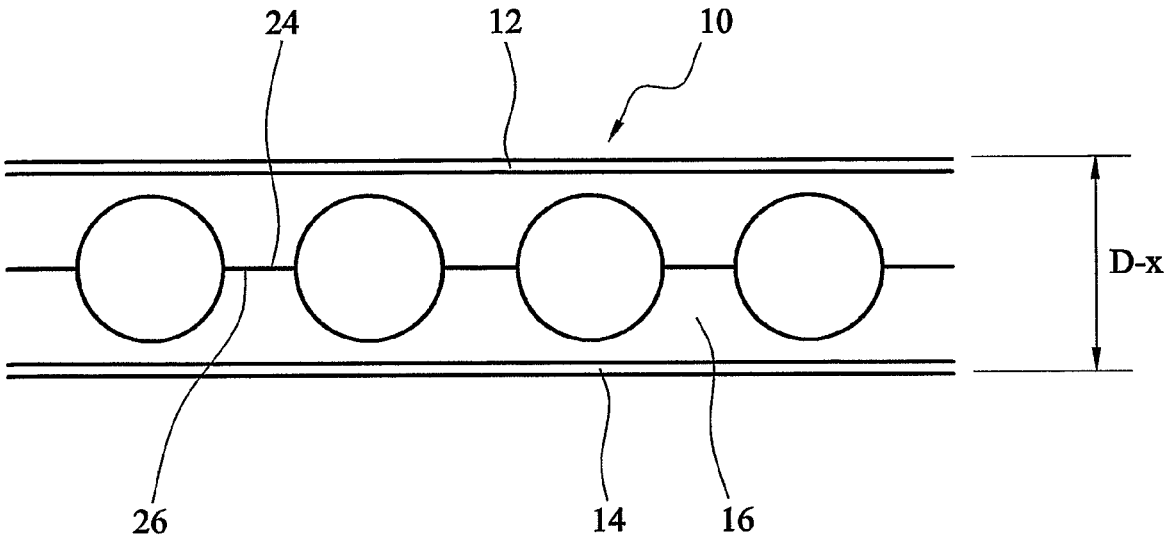
FIGS. 2*a* and 2*b* illustrate a finished cellular beam and cut pattern, respectively, produced according to the method of PCT/GB2004/005016.

Cellular beams produced according to the method of PCT/GB2004/005016 are also particularly suitable for use in the present invention. FIGS. 2*a,b* and 3*a,b* illustrate finished cellular beams and cut patterns produced according to the method of PCT/GB2004/005016.

The method according to PCT/GB2004/005016 comprises the steps of taking a universal beam, making a cut generally longitudinally along the web thereof, making a second cut along the web on a path differing from the first path of the first cut, separating the cut halves of the beam, and welding the halves together, characterised in that a width of material or ribbon is defined by the two cuts of an amount equal to the desired reduction in depth of the finished cellular beam.

Figure 2B:
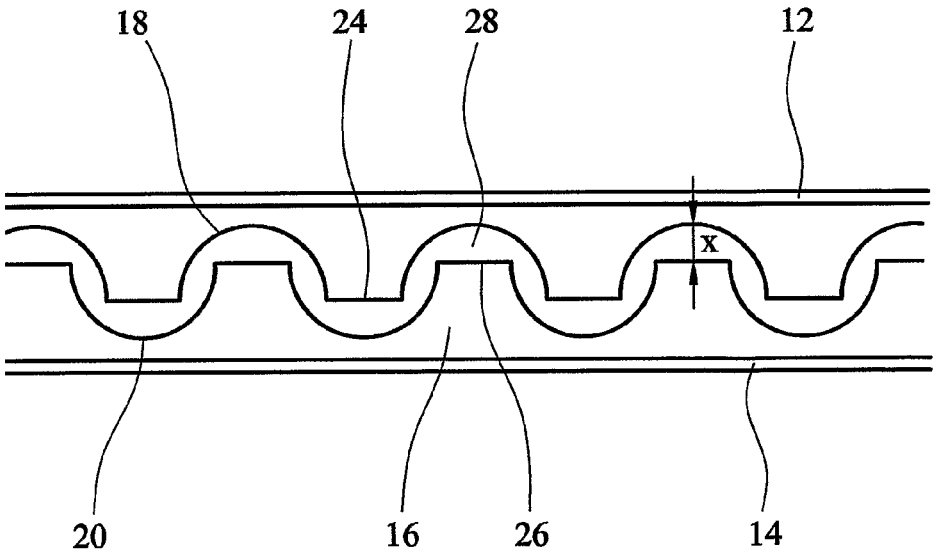

As shown in FIGS. 2*a* and 2*b*, the cuts (18,20) are spaced further apart from one another and define a ribbon (28) of material therebetween. The beams are separated and moved longitudinally relative to one another and the adjacent rectilinear portions (24,26) welded together as before. The thickness of the beam produced in accordance with PCT/GB2004/005016 is less than the thickness D of the beam produced in accordance with EP 0324206 by the amount "x", the width of the narrowest portions of the ribbon (28). As "x" may be varied at will, the thickness of the finished beam may be specified precisely.

Figure 3A:
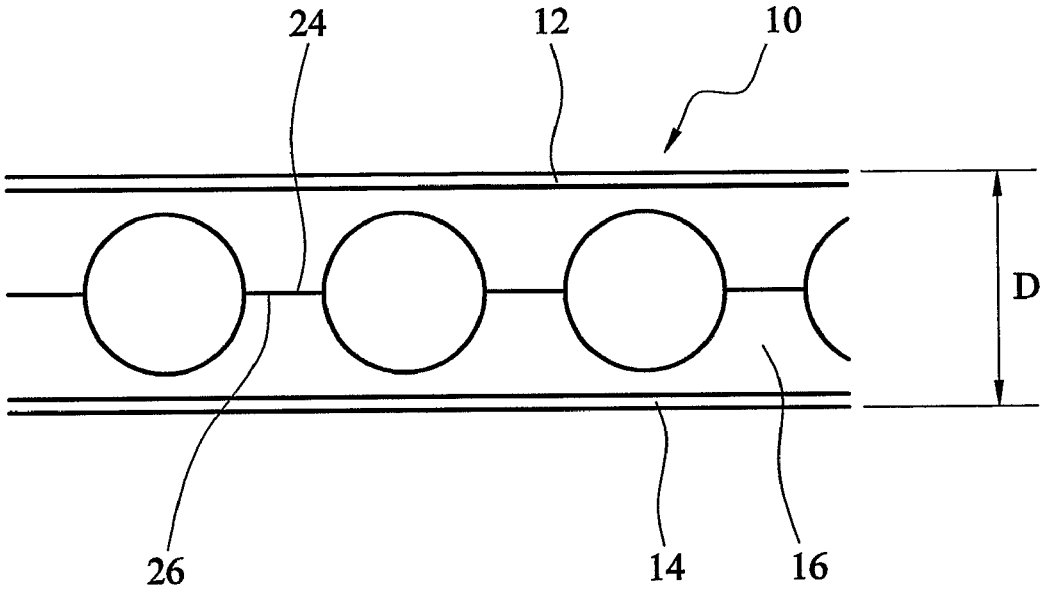
FIGS. 3*a* and 3*b* illustrate another finished cellular beam and cut pattern, respectively, produced according to the method of PCT/GB2004/005016.
Figure 3B:
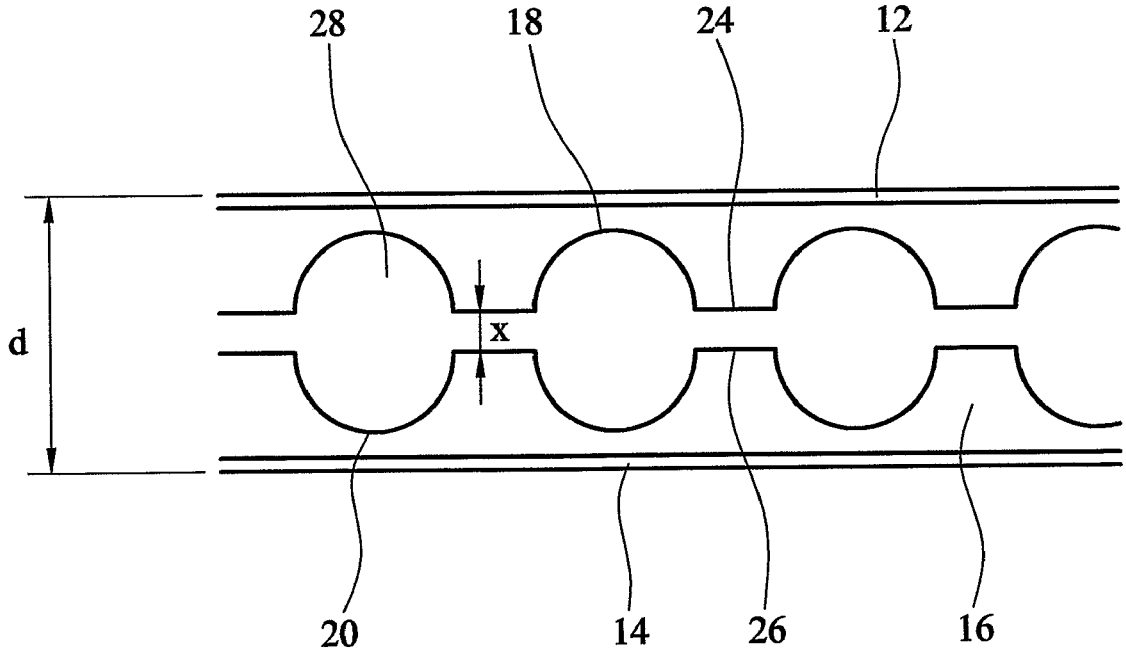

As shown in FIGS. 3*a* and 3*b*, the ribbon (28) contains a great deal more material and, since the rectilinear portions (24,26) are already opposite one another, the two halves of the beam do not need to be moved longitudinally relative to one another before welding. This produces a beam of thickness d-x, i.e. less than the thickness of the original beam by the amount "x" in FIG. 3(*b*). That is, in this embodiment of PCT/GB2004/005016, the cellular beam produced has a depth less than the universal beam from which it is produced. In certain circumstances, this construction of beam is preferable to producing a cellular beam from the smaller initial universal beam, either because such is not available or because the section thickness (of the web and/or flanges) of a smaller beam is not sufficient to meet the strength requirements needed.

While the methods of EP 0324206 and PCT/GB2004/005016 have been described in relation to the attaching together of the two parts of a single cut universal beam, it is preferable according to the present invention to use parts from different cut universal beams in order to produce asymmetrical cellular beams.

Figure 4B:
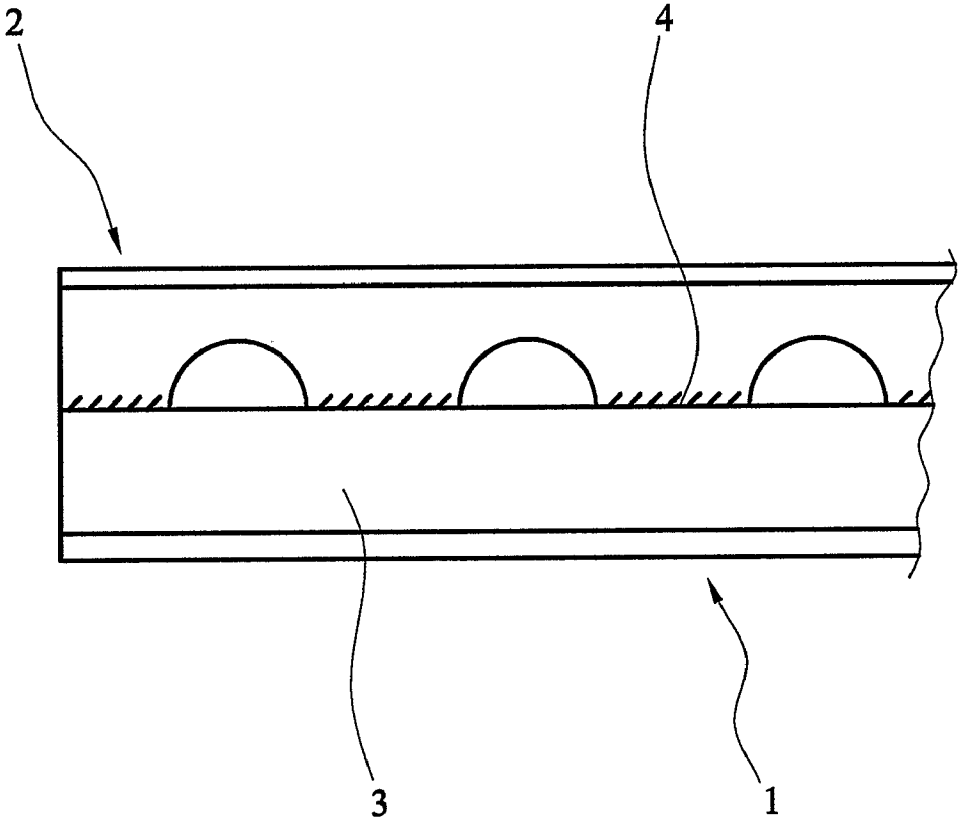
FIGS. 4*a* and 4*b* illustrate an end view and side view, respectively, of a finished cellular beam produced in accordance with an embodiment of the present invention.
Figure 4A:
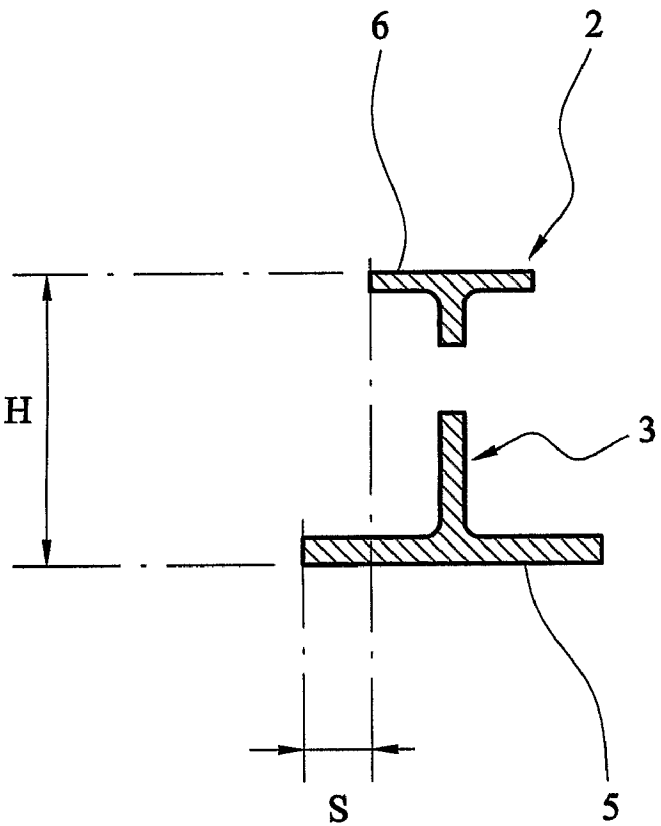

FIGS. 4*a* and 4*b* illustrate a finished cellular beam (1) produced in accordance with an embodiment of the present invention. Cellular beam (1) comprises two parts, namely an upper, cellular T-section (2) and a lower, solid T-section (3). The two parts are welded together to form a joint (4).

The method of producing a beam as shown in FIGS. 4*a* and 4*b* involves taking a first universal beam and cutting it in accordance with the method of EP 0324206 described above (see FIG. 1*b*). A second universal beam is then cut along the web parallel to the longitudinal axis. A part of the first universal beam is then welded to a part of the second universal beam to produce the finished cellular beam shown in FIGS. 4*a* and 4*b*.

Such a cellular beam has greater vertical shear capacity as compared to other cellular beams. Other structural advantages provided by such cellular beams are that the lower, solid T-section (3) enhances web post buckling and Vierendeel bending capacity. When the beam is designed to be composite with the floor slab, a straight cut lower T-section increases the usable tensile area of the lower section. In addition, the straight cut at the opening can also be formed such that the level surface provides support for the reinforcement, or post-tensioning tendons. This aids construction, and ensures that tendons and reinforcement are not positioned too low.

The first and second universal beams may have the same flange widths, resulting in the production of a symmetrical cellular beam. Preferably, the first and second universal beams have different flange widths, resulting in the production of an asymmetrical cellular beam, as shown in FIG. 4*a*. The projection (S) of the bottom flange (5) beyond the top flange (6) is achieved by choosing suitable top and bottom parts (2,3).

Cellular beams can be prepared according to any of the above methods in order to produce beams having different dimensions and shapes. In each variation, the finished beam is produced with a required depth, and with a series of circular or semi circular or other shaped openings along its length. In the preferred embodiments of the invention in which the cellular beams are asymmetric (see for example FIG. 4*a*), the dimensions of the top and bottom flanges are selected according to the particular requirements of the system.

Beams can be manufactured in any suitable size and form, depending on the requirements of the floor construction system. Beams can be produced with webs having a depth ranging from 100 mm to 2500 mm in 1 mm increments. A preferred range of depths is from 140 mm to 350 mm. Floors constructed from such beams are referred to in this specification as being ultra-shallow. Flange width range is only limited by the available material. Preferred flange widths are in the range 100 mm to 600 mm. Beams can be supplied having cells/openings of various shapes and dimensions. For example, beams can be provided with substantially circular cells having diameters ranging from 50 to 2000 mm. A preferred range of diameters is 75 mm to 250 mm. The distance between cells ("cell pitches") can vary from 1.15× the cell diameter upwards. Preferably, the cell pitch is 1.2× cell diameter to 3× cell diameter.

Figure 5:
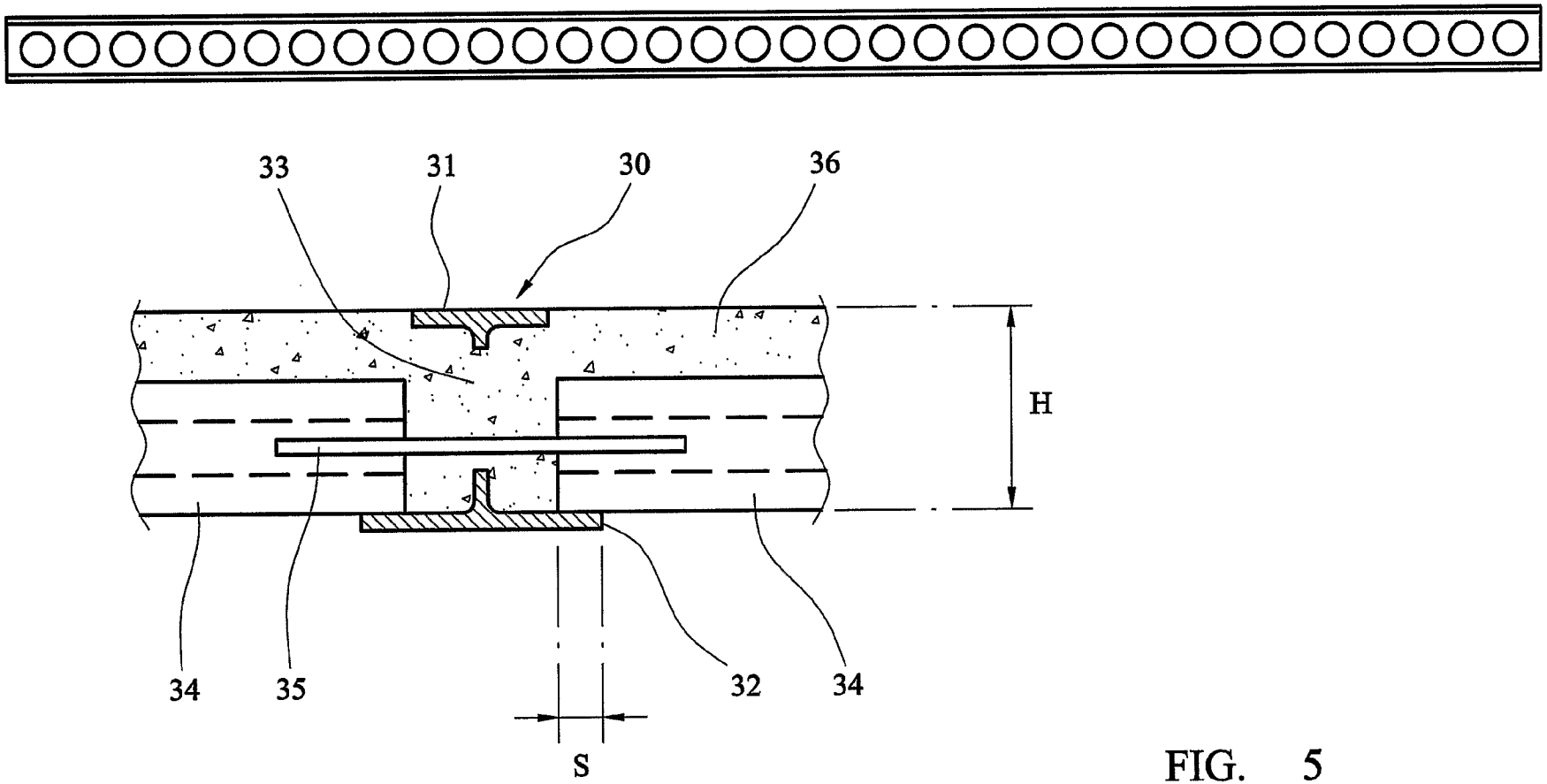
FIGS. 5-7 illustrate floor construction systems according to embodiments of the present invention in which the floor units are pre-formed concrete.
Figure 6:
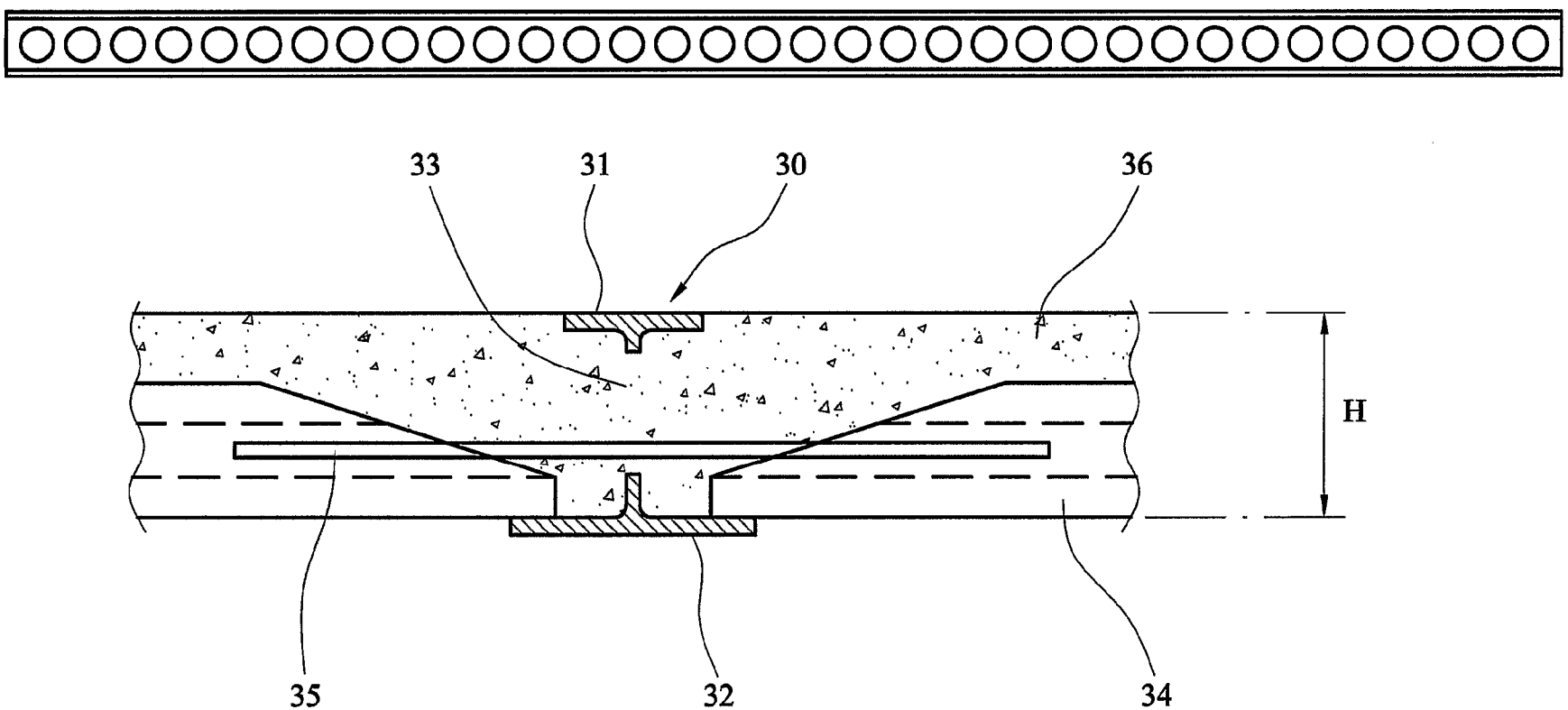
Figure 7:
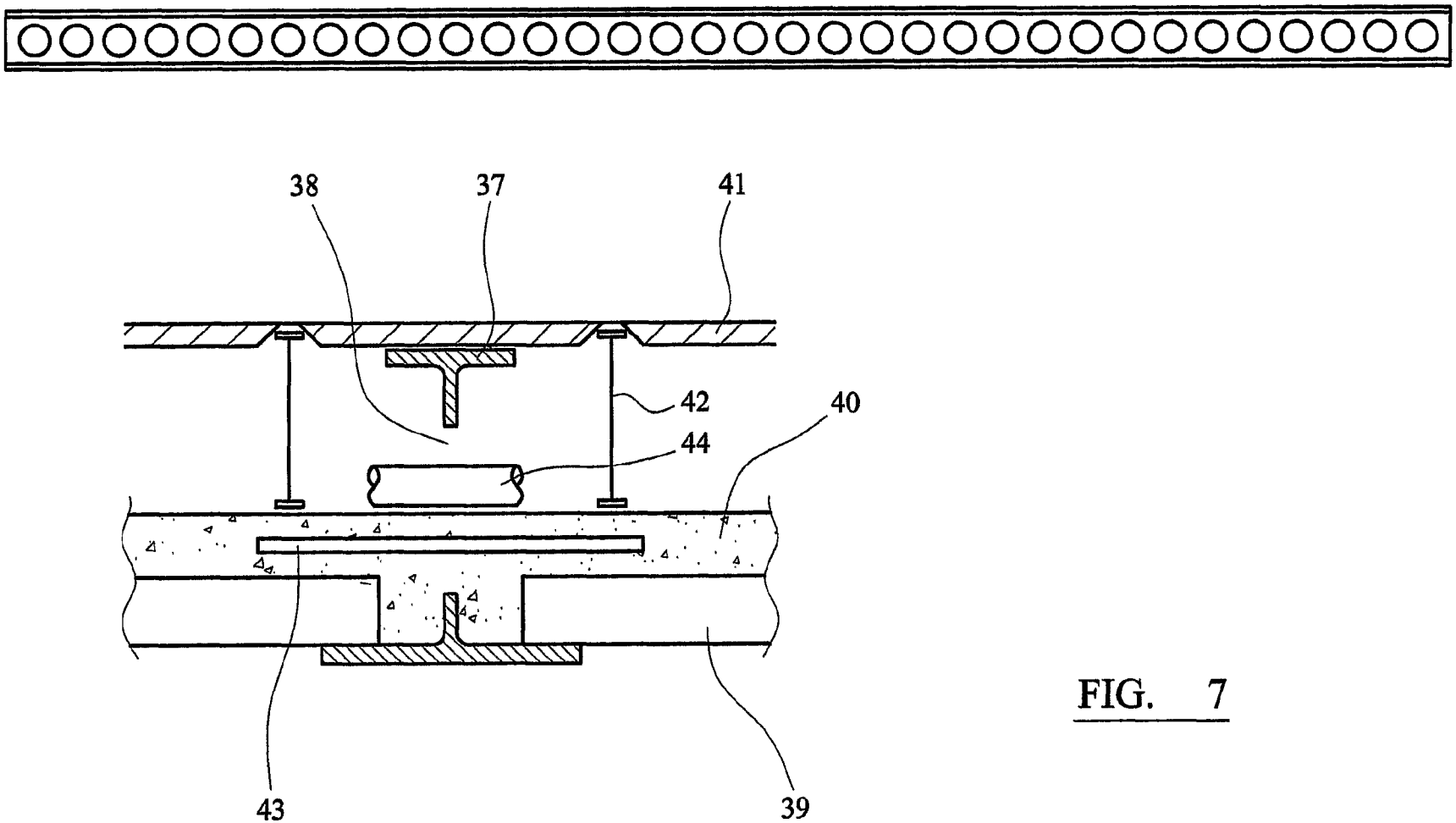

FIGS. 5-7 illustrate floor construction systems according to embodiments of the present invention in which the floor units are preformed concrete. In the embodiment shown in FIG. 5, an asymmetric cellular beam (30) forms part of the support structure for floor units in the form of pre-cast concrete units (34). The cellular beam (30) has an upper flange (31) and a lower flange (32). The upper flange (31) has a smaller width than the lower flange (32), which enables the pre-cast concrete units (34) to be lowered into position on the lower flange (32) without hindrance from the upper flange (31). The pre-cast concrete units (34) are tied together by reinforcement rods (35) or other mechanical means which extend through the openings (33) in the beam (30) so that building regulations are satisfied and/or composite action is achieved. The pre-cast concrete units (34) may be solid or hollow core units. As shown in FIG. 5, the construction may use topping material (36), the topping material filling the openings (33) in the beam. The topping material may be structural concrete topping or non-structural topping material.

In the embodiment of the invention shown in FIG. 6, an asymmetric cellular beam (30) forms part of the support structure for floor units in the form of pre-cast concrete units (34) having chamfered ends. The pre-cast concrete units (34) are tied together by reinforcement rods (35) or other mechanical means which extend through the openings (33) in the beam (30) so that building regulations are satisfied and/or composite action is achieved. The pre-cast concrete units (34) may be solid or hollow core units. As shown in FIG. 5, the construction may use topping material (36), the topping material filling the openings (33) in the beam. The topping material may be structural concrete topping or non-structural topping material.

The system of the present invention has significant advantages when combined with ThermoDeck®. ThermoDeck® uses continuous holes formed within pre-cast units to pass air and other services, giving an extremely energy efficient heating, cooling and distribution system. The depth of ThermoDeck® varies with span and load, as do the hole sizes and positions. The present invention has the advantage that beams can be made to match the depth of the ThermoDeck®, the hole size and the hole position. If every hole is not required for passing services, composite action can still be achieved by careful selection of the openings for placement of the tying reinforcement and in-situ concrete. Improved continuity and passage of services can be achieved by providing suitable sleeves between ThermoDeck® units, passing through the openings in the beams of the present invention. This provides the most compact and efficient solution.

FIG. 7 shows a system in which a raised floor (41) is supported by supports (42) above a pre-cast concrete unit (39) having a structural topping (40), which in turn is supported by a cellular beam (37) having openings (38). The pre-cast concrete units (39) are tied together by reinforcement rods (43) or other mechanical means which extend through the openings (38) in the beam (37). Service structures (44) such as a power cable are disposed in the space between the raised floor (41) and the structural topping (40), the service structures (44) extending through the openings (38) in the beam (37). The opening (38) can be offset to achieve the most favourable detail. The embodiment of FIG. 7 allows longer spans between beams or lighter beam weights.

In the case of pre-cast concrete units, insertion of tying/reinforcing rods, service structures and ducting sleeves, may be effected by the provision of pre-chamfered ends on the pre-cast hollow core units, or by locally breaking out the top of the pre-cast hollow core unit at the production stage or on site. This enables easy access to the hollow core for placement of both reinforcement and in-situ concrete. Service structures can also enter and exit the flooring system at the required locations.

Figure 8:
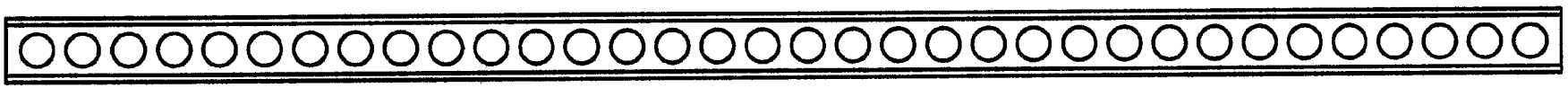
FIGS. 8, 9*a* and 9*b* illustrate floor construction systems according to embodiments of the present invention in which concrete floor units are formed in-situ.
Figure 8:
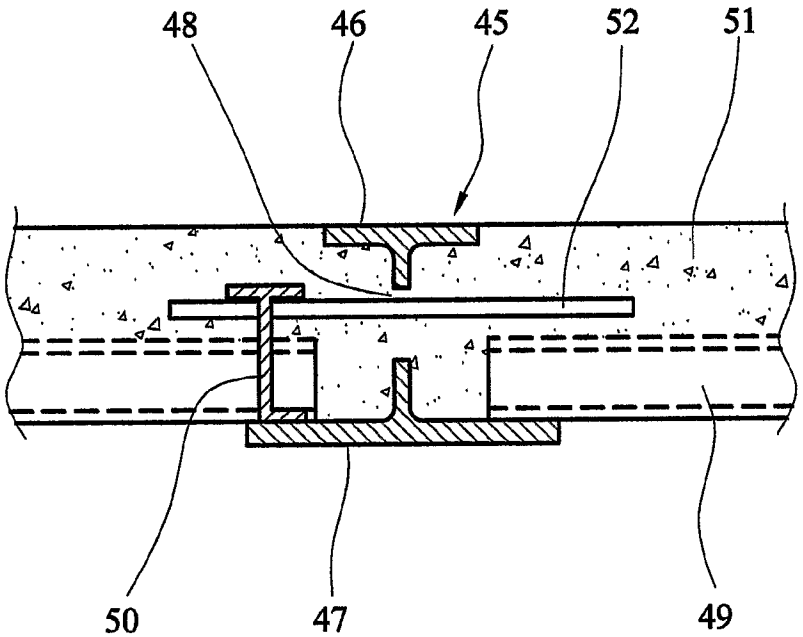
Figure 9B:
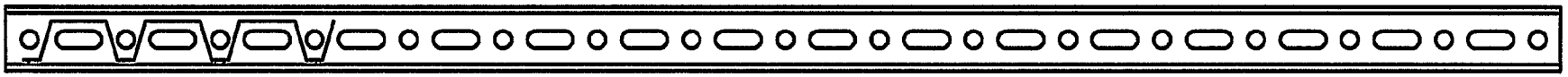
Figure 9B:
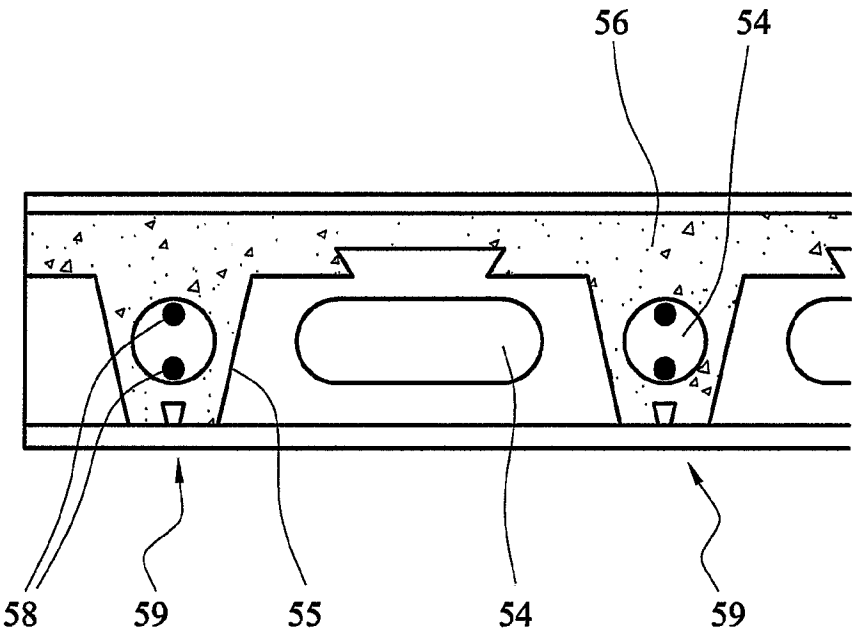
Figure 9A:
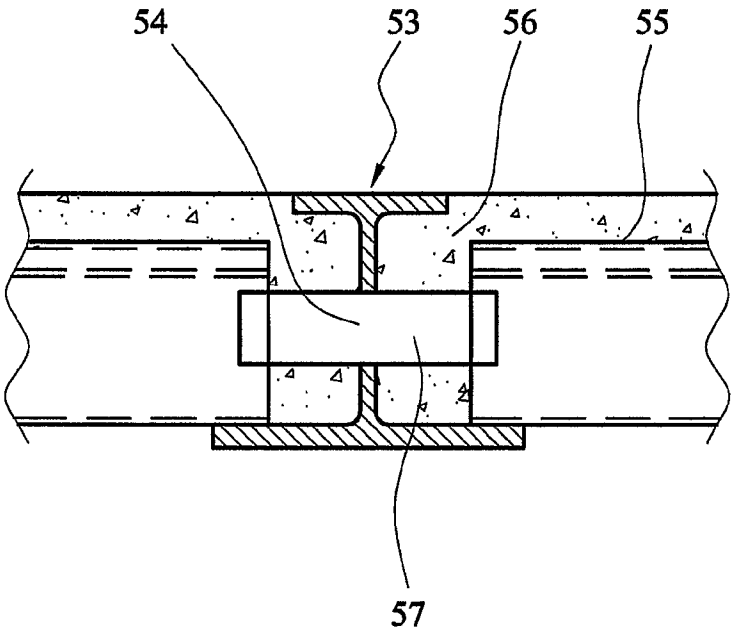

FIGS. 8, 9*a* and 9*b* illustrate floor construction systems according to embodiments of the present invention in which concrete floor units are formed in-situ. FIG. 8 shows an asymmetric cellular beam (45) supporting decking (49) on its lower flange (47). As shown, the decking (49) may be attached to the lower flange (47) by means of studs (50) which are welded or mechanically fixed in place. The lower flange (47) is made sufficiently wide to enable the decking (49) to be safely manoeuvred into position and provide the required bearing/support. Concrete is poured onto the decking (49) and allowed to set so as to form an in-situ concrete unit (51). During production, the concrete flows through the openings (48) in the beam (45). When in-situ concrete is poured and cast, the passage of concrete in its liquid state through the web openings provides the necessary composite action between the steel beam and the concrete once set. Web post buckling is thus prevented, horizontal shear capacity between cells is significantly enhanced, as is vertical shear capacity, Vierendeel bending capacity, global bending capacity, inertia, inherent fire resistance, and thermal mass.

As shown in FIG. 8, reinforcement means (52) can extend through the openings (48) and provide additional horizontal shear transfer between the in-situ concrete slab (51) and the beam (45). This can enhance composite action.

The beam can be used with post-tensioned concrete slabs by placing the reinforcement tendons longitudinally through some or all of the openings in the beam, casting a concrete slab around the tendons and then tensioning the tendons as required.

FIGS. 9*a* and *b* are end and side views, respectively, of an embodiment of the invention in which deep trough metal decking (55) having ribs (59) is supported by an asymmetric cellular beam (53) having openings (54). Concrete is poured into the decking (55) and allowed to set in order to form an in-situ concrete floor unit (56). As shown in FIG. 9*a*, a duct sleeve (57) can be disposed in the opening (54). Service structures may extend through the openings (54). Reinforcement rods (58) can extend between adjacent in-situ floor units (56) via the openings (54), as required.

Where deep trough metal decking (55) is used with large spacing between the ribs (59), the pitch and shape of the openings (54) in the beams (53) can be carefully selected to match the decking geometry. An opening (54) of sufficient size is located at each rib as and if required. An opening (54) of sufficient size is located between each rib for the passage of ducting, services, lighting etc. as and if required. This embodiment of the invention enables the most compact floor system, incorporating services, structure and thermal and sound insulation, to be achieved.

Figure 10A:
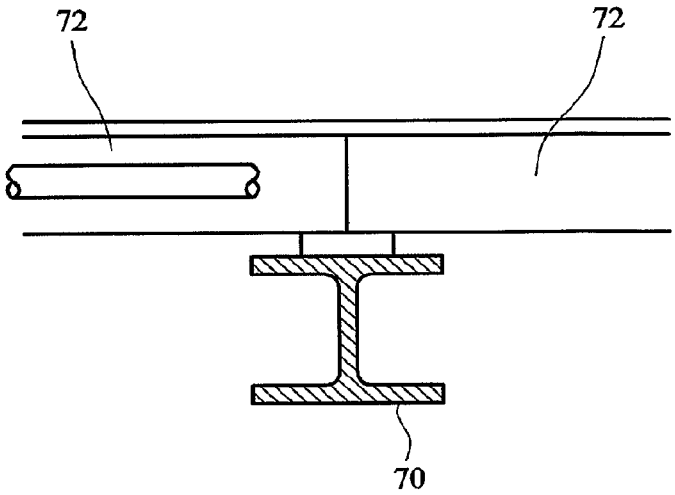
PRIOR ART FIG. 10a
FIGS. 10*a-c* illustrate known floor construction systems in which the floor units are timber joists.
Figure 10B:
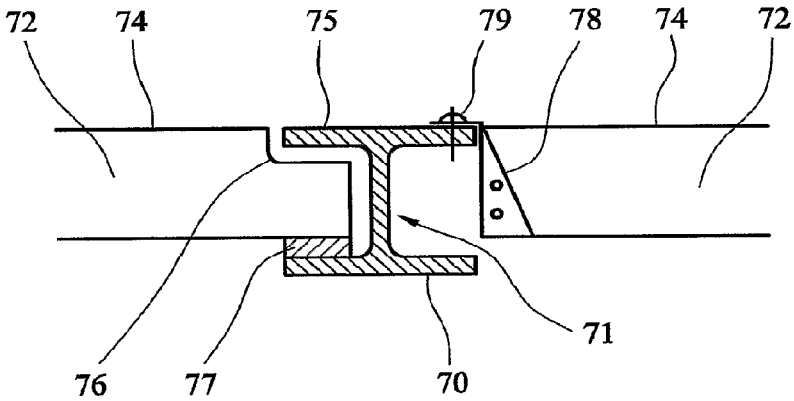
PRIOR ART FIG. 10b
Figure 10C:
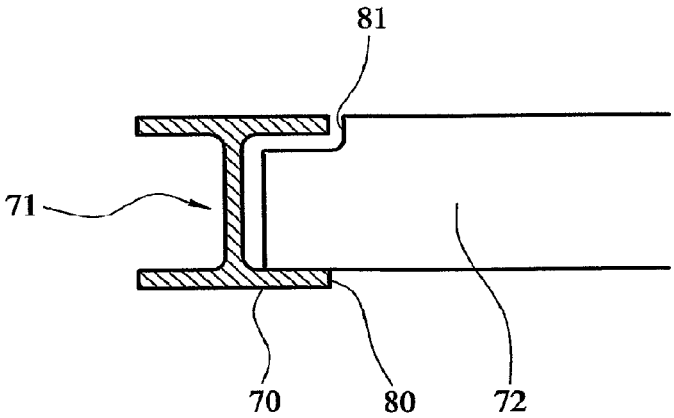
PRIOR ART FIG. 10c

FIGS. 10*a-c* illustrate a known floor construction system in which the floor units are timber joists. In each of FIGS. 10*a-c*, the beam (70) is symmetric and has a solid web (71). As shown in FIG. 10*a*, when shallow floor systems are not required, the timber joists (72) are supported above the beam (70). However, when shallow floor systems are required, known systems based on symmetric beams (70) having solid webs (71) have a number of limitations, as shown in FIGS. 10*a* and 10*b*. Due to the web (71) being solid, there is no route for passing service structures through the beam. Furthermore, adjacent joists cannot be attached to each other through the beam.

Existing beams (70) cannot be made to any required depth. Consequently, if the depth of the timber joist (72) is less than the depth of the beam (70), then as shown in FIG. 10*b*, additional modifications are required so that the top surface (74) of the joist is level with the top surface (75) of the upper T-section of the beam (70). One option shown in FIG. 10*b* is to cut a notch (76) out of the joist (72) and support the joist on a sole plate (77). Another option shown in FIG. 10*b* is to support the joist (72) in a joist hanger (78) attached to the upper T-section of the beam (70) by a suitable fixing (79). Such additional modifications increase construction times and costs.

As shown in FIG. 10*c*, if the depth of the joist (72) is greater than the depth of the web (71) of the beam (70), then in order for the joist to be supported on the lower flange (80) of the beam, a notch (81) has to be formed in the upper surface of the joist. This increases construction times and costs.

Figure 11A:
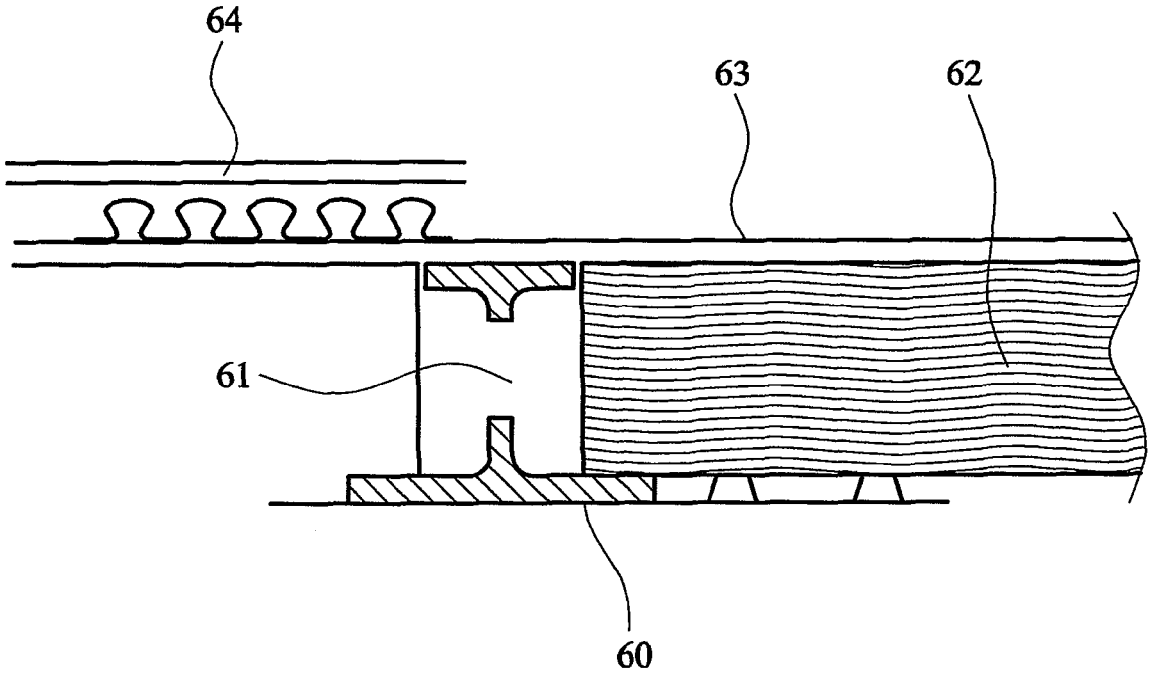
FIGS. 11*a*, 11*b*, 12 and 13 illustrate floor construction systems according to embodiments of the present invention in which the floor units are timber joists.
Figure 11B:
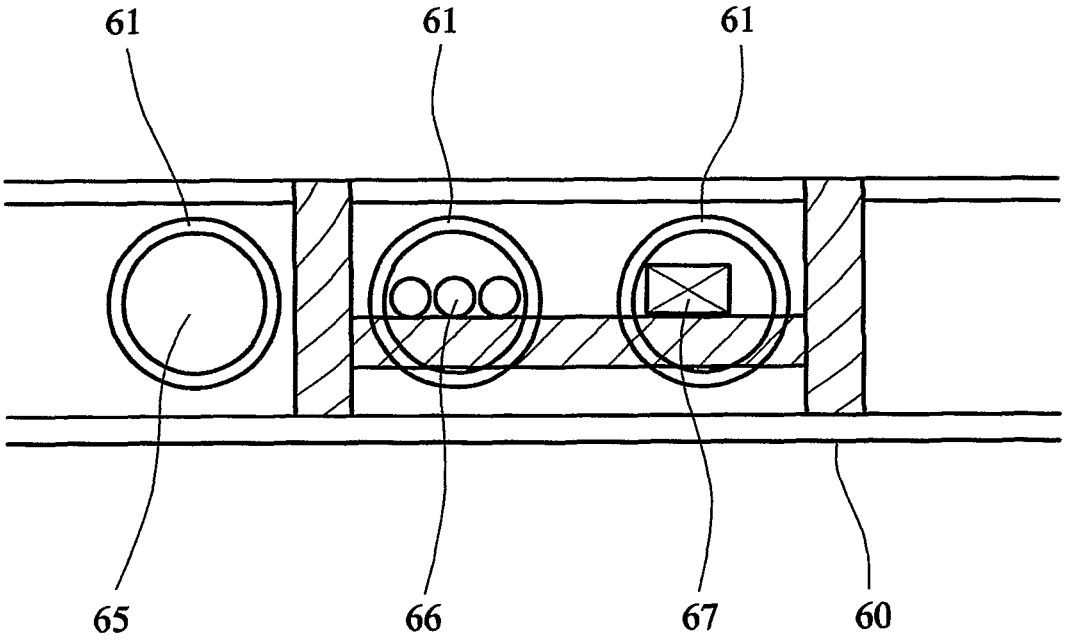

FIGS. 11*a* and *b* illustrate a floor construction system according to an embodiment of the present invention in which the floor units are timber joists. FIGS. 11*a* and *b* are end and side views, respectively, showing a timber joist (62) supported by an asymmetric cellular beam (60) having openings (61). As shown in FIG. 11*a*, a deck (63) is disposed on top of the beam (60) and timber joist (62). A finish (64) can be disposed on the deck (63) as required. As shown in FIG. 11*b*, air ducts (65), water supply (66) and power supply (67) can pass through the openings (61). The pitch of the openings is selected to suit the pitch of the joists.

Figure 12:
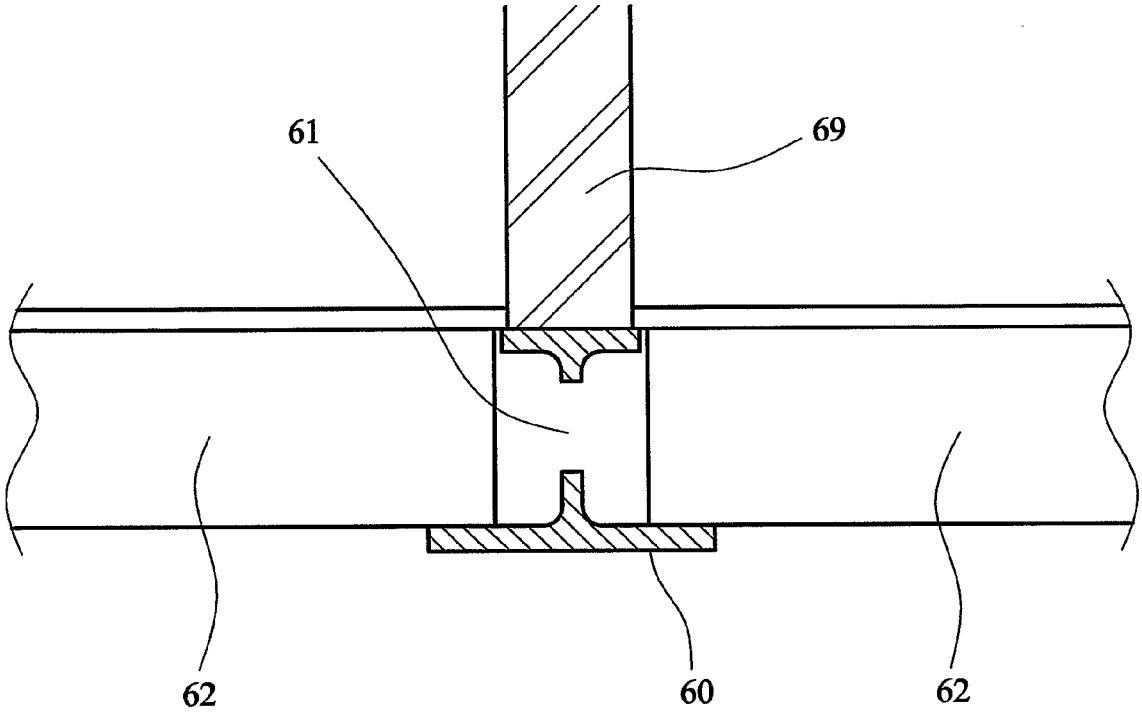

The beam can be sized to meet any requirement, including fire regulations, such that the beam has sufficient mass and strength to endure the required fire period without the need for fire protection. As shown in FIG. 12, the variable depth of beams prepared according to the present invention has the advantage that beams can be provided which match the timber joist depth, thereby avoiding the additional modifications required in known systems, such as those shown in FIGS. 10*a*-*c*. In addition, the lower flange of the beam (60) can be sized so as to provide the required bearing for the timber joists (62). The upper flange of the beam (60) can be sized to enable optimised positioning of the joists, as well as providing support for a wall structure (69). The present invention therefore enables the most compact construction to be achieved.

Figure 13:
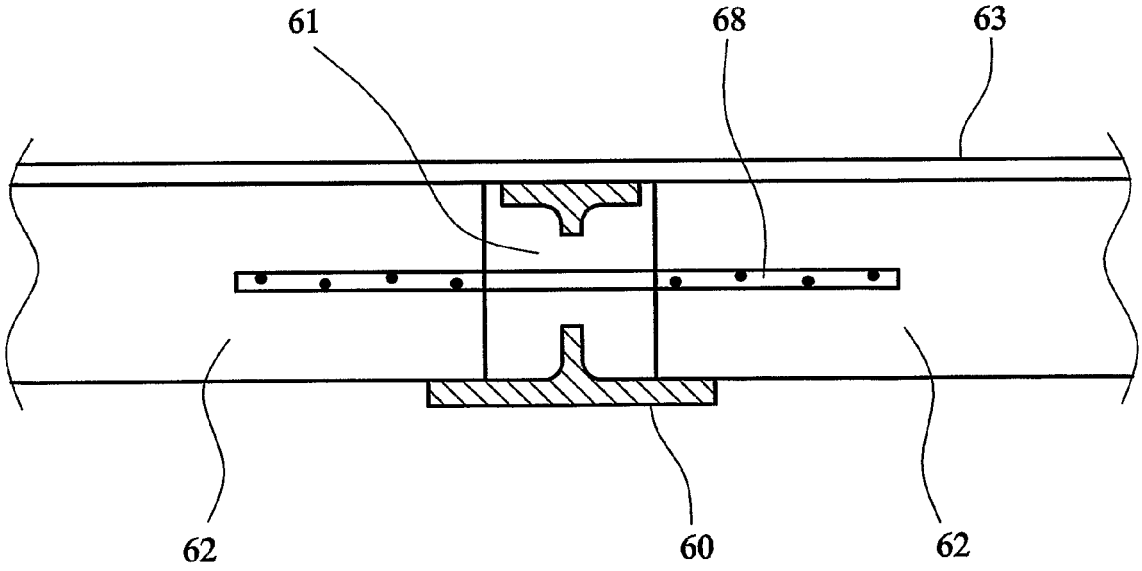

As shown in FIG. 13, adjacent timber joists (62) can be attached to each other by means of a tie (68), which extends through the opening (61) in the beam (60). This makes the flooring more robust.

Some or all of the following steps may be taken when constructing a floor system according to the present invention. The first step is to establish the required floor unit type and the required floor thickness. Then the cellular beam depth is set from the top of the lower flange to match the floor unit detail. For example, the minimum bearing for a pre-cast concrete unit is 75 mm, which dictates that the upper flange should ideally be at least 150 mm narrower than the lower flange width. If metal decking or timber is being used the minimum bearing is usually 50 mm (although it can be as low as 35 mm), which dictates that the upper flange should ideally be at least 100 mm narrower than the lower flange width.

Construction site safety is of primary importance. The pre-cast concrete units have to be positioned by crane. A stack of metal decking sheets would be similarly lowered by crane, but then each sheet is separated and positioned by hand. Regardless of the floor plate construction, be it timber, pre-cast concrete units or metal decking, with or without in-situ concrete, asymmetry of the cellular beam enables safer handling of materials as they cannot easily fall through or damage the upper flange.

If cells (openings/holes) are used to allow passage of physical services or allow air flow, then the cell shape and dimensions will be selected to meet the demands set. The pitch of the cells is selected according to the following considerations. If profiled metal decking is used the pitch can be set to best match the deck shape (see FIG. 9*b*). If timber joists are used the pitch can match the joist centres so that holes only exist between the joists. If hollow core pre-cast units are used, the holes pitch can also be set to best match the hollow cores (see FIGS. 5-7). Otherwise, the pitch is set to suit any steel reinforcement bars being incorporated into the system, or simply to ensure that welding is reduced to the minimum required (the closer the cells are positioned together, the less welding is provided), thereby further reducing production costs.

The above criteria or any other criteria relevant in the specific circumstances may be used to set the beam depth, cell shape, cell pitch, and how much wider the lower flange must be than the top flange.

Taking account of load spans and forces, the required flange/web thickness and strength to meet all stages of construction and design life for the beam are established. Should internal forces be unsuitably high, the engineer can adopt a solid T-section for either the upper or lower part of the cellular beam, with openings only in the opposing T-section (see FIGS. 4*a* and 4*b*). This significantly increases the beam strength.

The cellular beam may be designed to act structurally in conjunction with the concrete floor, called composite action, or to resist all forces in its own right, called non-composite action. Composite design is the most structurally efficient use of material. Composite action is achieved by providing suitable and adequate horizontal shear transfer between steel and concrete. Traditional construction achieved this by using some form of welded shear stud. This is an expensive secondary procedure usually undertaken on site. Site welding of studs cannot take place if steel is wet.

Corus Slimdek® achieves composite shear transfer by hot rolling a suitable shear key to the upper flange. This has a significant drawback. Concrete must be placed over the top flange of Slimdek® beam to achieve composite action. The minimum depth of concrete over the top flange is 30 to 60 mm. As beams are only available from 272 mm deep to 343 mm deep, this makes construction possibilities very restricted.

The present invention achieves composite action by primarily utilising the shear key between concrete and steel when the concrete passes through the openings in the webs. This has significant structural advantages. The engineer is free to set any suitable construction depth, further reducing material usage to a minimum. Furthermore, shear key between concrete and steel is achieved without the need for additional welded or mechanically fixed shear keys, further reducing manufacturing costs and site labour.

For very high composite horizontal shear key forces, the inherent shear key strength of beams according to the present invention can be supplemented with the addition of mechanical shear keys in the traditional way.

If the most efficient solution is hampered by excessive deflection, an engineer usually has little choice but to select a heavier/bigger beam, unless he opts to have the beam cambered by specialist rolling or by hydraulically jacking the beam to give a permanent pre-set. Both of these options are expensive, and crude in application. Accuracy tends to be to the nearest 20 mm increment, plus or minus 1 mm per mm of beam length.

In contrast, beams according to the present invention can be supplied with cambers to millimeter accuracy at no extra cost. This is achievable by virtue of the unique manufacturing process. After the upper and lower T-sections are suitably prepared, they are joined on a jig that is either straight, cambered, curved or any combination of the three. When welded the desired shape is held in the section.

Typically, a floor will be completely erected on one side of the beam first. As a result, beams according to the present invention and their connections are designed to resist torsional forces. The advantage of this approach is that it avoids the need for site propping during construction, further reducing site costs and minimising an operative's exposure to unnecessary risk. However, for very large spans, beam spacing or loading, it may be preferable to prop the construction. This can also be accommodated.

Once the decking system has been positioned, steel reinforcement bars or other suitable mechanical attachment may be installed to comply with building regulations for achieving robustness of structure.

The present invention has significant benefits as compared to existing shallow floor steel systems:

a) Floors can be made to any exact depth;

b) Floors can be significantly shallower than existing rolled steel solutions;

c) The beams have, inherent in their manufacture, numerous openings in the webs. These allow for reinforcement to be passed through the openings in the web, or provide the required shear transfer between steel and cast in-situ concrete to afford composite action, significantly enhancing strength and stiffness. These openings are much larger than drilled holes so can also be used for the passage of service ducts within the depth of the system. Beam span and load capacity is significantly enhanced by an infinitely variable range of possible section combinations, depth, cell/opening size and pitch configurations, and choice of metal decks, depending on the desired floor properties. Beams according to the present invention can be used with any commercially available metal deck designed specifically for the ultra shallow floor market. Cell diameter, pitch and position can be adjusted to suit the corrugations of each deck, allowing service structures to be accommodated below and within the deck voids, thus further significantly reducing overall construction depth. These web openings can also be used to pass reinforcement above and within the deck troughs.

d) The steel beams used in the present invention are significantly lighter in weight than known rolled steel solutions due to the wide range of sections that can be used to comprise the top and bottom T-sections.

e) The beams can be cambered or curved to form a rise or an arch, by adjusting the size and shape of the upper T-section cut profile in relation to the lower T-section profile in direct proportion to the required radius and beam length, such that when the T-sections are brought together for welding at the required radius all of the holes line up to give the required geometry. Where deflection limits are dictating the beam size, cambering in this way allows a beam with lower inertia to be used, saving beam weight/cost and or construction depth.

f) The system is able to be combined with metal decking, pre-cast units, in-situ concrete, timber decking and other flooring systems and floor casting formers. The beam can act non-compositely or compositely where the intended flooring system allows.

The invention claimed is:

1. A method of constructing a floor, comprising the steps of:

(a) arranging a plurality of I- or H-shaped beams comprising at least one pre-formed beam having flanges and a web extending between the flanges, the or each pre-formed beam having openings located in the web so as to form a support structure for floor units, wherein the or each pre-formed beam comprises a cellular T-section and a solid T-section welded together, wherein each T-section comprises a flange and a partial web, wherein the or each pre-formed beam is or has been obtained by a process comprising the steps of:

(b) taking a first I- or H-shaped beam, making a first cut generally longitudinally along the web thereof, making a second cut generally longitudinally along the web thereof, the second cut being non-parallel to the first cut, the two cuts defining the shape of two cellular T-sections comprising rectilinear sections lying on alternative sides of a longitudinal centre line of the web and at least partly curvilinear sections joining the closest ends of the adjacent rectilinear sections, separating the two cellular T-sections from the first beam;

(c) taking a second I- or H-shaped beam, making a cut along the web thereof parallel to the longitudinal axis defining the shape of two solid T-sections, separating the two solid T-sections from the second beam; and (d) welding the partial web of one cellular T-section of the first beam to the partial web of one solid T-section of the second beam; and (e) disposing floor units between the beams, the floor units being accommodated between the horizontal flanges of the beams.

2. A method according to claim 1, wherein the beams are asymmetric, with the top flange being narrower than the bottom flange.

3. A method according to claim 1, wherein the floor units are pre-formed concrete slabs.

4. A method according to claim 1, wherein the floor units are timber joists.

5. A method according to claim 1, further comprising the step of disposing decking between the bottom flanges of the beams, the floor units being disposed on top of the decking.

6. A method according to claim 5, further comprising the step of pouring concrete onto the decking so as to form concrete floor units in-situ.

7. A method according to claim 1, wherein adjacent floor units are attached to each other via the openings.

8. A method according to claim 7 wherein the floor units are pre-formed concrete slabs, and wherein adjacent concrete floor units are attached to each other by reinforcing means.

9. A method according to claim 7 wherein the floor units are timber joists, and wherein adjacent timber joists are bolted together.

10. A method according to claim 1 further comprising the steps of disposing decking between the bottom flanges of the beams and pouring concrete onto the decking so as to form concrete floor units in-situ, wherein the concrete flows through the openings in the beams so as to form a composite structure.

11. A method according to claim 1, wherein service structures are disposed within the floor, passing through the openings in the or each beam.

12. A method according to claim 1, wherein the openings are pre-formed to have any desired shape.

13. A method according to claim 1, wherein the openings are pre-formed to have any desired dimensions.

14. A method according to claim 1, wherein the openings are pre-formed to have any desired positioning with respect to each other.

15. A method according to claim 1 further comprising the steps of disposing decking between the bottom flanges of the beams and pouring concrete onto the decking so as to form concrete floor units in-situ, wherein adjacent concrete floor units are attached to each other by reinforcing means.

* * * * *